United States Patent [19]

Graves et al.

[11] Patent Number: 4,659,030

[45] Date of Patent: Apr. 21, 1987

[54] LATERAL POSITIONING AND ADJUSTMENT MECHANISM FOR A WEB PRESS

[75] Inventors: Gene E. Graves, Centerville; Dinesh G. Punater, Dayton, both of Ohio

[73] Assignee: Harris Graphics Corporation, Melbourne, Fla.

[21] Appl. No.: 786,570

[22] Filed: Oct. 11, 1985

[51] Int. Cl.[4] ..... B65H 19/30; B65H 16/06

[52] U.S. Cl. ..... 242/58.6; 242/68

[58] Field of Search ..... 242/58.6, 68, 68.4, 242/129.6, 129.62

[56] References Cited

U.S. PATENT DOCUMENTS

| | | | |
|---|---|---|---|
| 3,176,928 | 4/1965 | Saunders | 242/58.6 |
| 3,321,147 | 5/1967 | Martin | 242/58.6 |
| 3,424,394 | 1/1969 | Moore | 242/58.6 |
| 4,339,093 | 7/1982 | Shanklin et al. | 242/68 X |
| 4,346,655 | 8/1982 | Suter et al. | 101/153 |

*Primary Examiner*—Stuart S. Levy
*Assistant Examiner*—David Werner
*Attorney, Agent, or Firm*—Biebel, French & Nauman

[57] ABSTRACT

A lateral positioner and adjust mechanism is provided for an unwind station of a web press. The unwind station includes first and second arms pivotally mounted to a frame that cooperate for supporting for rotation a roll on a shaft. The arms can be raised and lowered to raise and lower the roll. In the subject mechanism, a wheel is mounted to a first end of the shaft extending beyond the first supporting arm, the wheel defining in its periphery a groove having opposing side walls. Each of the side walls defines an outward bevel. A block attached to the first arm defines thereon a ridge extending upwardly perpendicular to the shaft, the ridge having opposing side walls, each of which includes a bevel. The ridge is fittable within the groove. The block can be selectively moved toward and away from the first arm in a direction parallel to the shaft. As the roll shaft is raised into position, the ridge and groove engage, moving the shaft into correct lateral position. During operation of the press, lateral movement of the block will provide lateral adjustment of the roll.

10 Claims, 5 Drawing Figures

LATERAL POSITIONING AND ADJUSTMENT MECHANISM FOR A WEB PRESS

BACKGROUND OF THE INVENTION

The present invention relates generally to a web press into which a web of sheet material is fed from a roll located within an unwind station. More specifically, the invention relates to a mechanism for laterally positioning and adjusting the roll within the unwind station.

In a typical web press, the web of material is supplied from a large roll carried on a shaft that is supported for rotation within an unwind station. Due to the great weight of the roll, typically on the order of 1800 pounds (800 kg), the unwind station is usually provided with a mechanism for lowering a used roll to the floor and then, following initial positioning of a new roll, raising the new roll into operating position.

It is important that the roll be located within the unwind station in a proper lateral position. All further operations to be carried out upon the web, such as printing, perforating, folding and the like, will be placed in a lateral location with respect to the web depending upon the lateral positioning of the roll. The machines within the press for carrying out such operations are normally provided with their own lateral adjustment mechanisms. However, in the event the overall lateral position of the web requires adjustment, it is much simpler to adjust the roll rather than each of the machines within the press. Similarly, when it is necessary to change a roll during press operation, it is highly desirable that the new roll be positioned in the same lateral location as the used roll, to avoid having to reposition all other machines within the press.

In one type of unwind station, the shaft upon which the roll is carried is supported near each end by arms which may be pivotally raised and lowered by a pneumatic or hydraulic cylinder or the like. A wheel is carried at one end of the roll shaft, the wheel having a recess defined entirely around the outer, peripheral edge of the wheel. Mounted to the side frame of the press is a block which has a pivotally connected member that can be moved into engagement with the recess of the shaft wheel when the shaft is located in its operating position. The block is connected to the frame by a mechanism which permits lateral adjustment of the block with respect to the frame. When the pivotal member is engaged with the shaft wheel recess, movement of the block results in lateral adjustment of the shaft and hence of the roll. Also, engagement of the pivotal member and the wheel recess serves to secure the shaft in its proper position without affecting its rotational performance.

While such an adjustment mechanism is effective for changing lateral position of the roll once it is installed within the unwind station, the described mechanism has several disadvantages relating to the installation or removal of a roll. Prior to lowering of a used roll from the unwind station, the lateral adjust mechanism must be disengaged from the shaft wheel. More importantly, once a new roll has been installed, the press operator may have to push the roll laterally until it is engageable with the adjust mechanism, which can be quite difficult due to the weight of the roll. Alternatively, the operator can move the adjust mechanism to the lateral position which the roll occupies, after which the mechanism can be used to readjust the roll to the desired position.

Either operation is relatively time consuming, increasing the non-productive time required for changing of the roll. Moreover, if the mechanism is readjusted to position the new roll, it is possible that the new roll may be placed slightly out of position. Unfortunately, this condition may be discoverable only after some of the web material has been used.

What is needed, therefore, is a lateral adjust mechanism for the roll shaft that not only enables lateral adjustment of the roll, but that positions the roll as it is installed within the unwind station. To increase the speed and efficiency of the roll changing operation, such a mechanism should accurately position the roll automatically as it is lifted into place.

SUMMARY OF THE INVENTION

The present invention provides a lateral positioner and adjust mechanism for use within an unwind station of a web press. The unwind station includes a frame, and a shaft is provided for supporting a roll of web material, the material typically being paper. First and second arms are pivotally mounted to the frame and cooperate for supporting the shaft for rotation thereon. The arms can be selectively and pivotally raised and lowered, and means is provided for retaining the arms in a raised position.

In the lateral adjust mechanism, the shaft extends at a first end beyond the first supporting arm. A wheel is mounted to the first end of the shaft, with the wheel defining in its peripheral edge a groove having opposing side walls. Each of the side walls defines an outward bevel. A block is attached to the first arm and defines thereon a ridge extending upwardly, perpendicular to the shaft. The ridge has opposing side walls, each of which includes a bevel, and the ridge is fittable within the groove. The block can be selectively moved toward and away from the first arm in a direction parallel to the shaft.

The groove and ridge are disposed in a vertical orientation. The bevel of the ridge walls is formed at a greater angle from vertical than the bevel of the groove walls. Further, the wheel is mounted to the shaft for rotation thereon.

The block may be movable by engagement with a screw shaft that is rotatably secured to the frame. An indicator means may be provided to display for an operator the lateral positioning of the roll.

Accordingly, it is an object of the present invention to provide a lateral positioner and adjust mechanism for both initially positioning and later adjusting a roll of web material in a lateral direction within an unwind station of a web press; to provide such a mechanism which will automatically position the roll to a preset lateral location as the roll is installed into the station; to provide such a mechanism which will automatically disengage as a used roll is lowered from the station; and to provide such a mechanism which is relatively simple in design, construction and operation.

Other objects and advantages of the present invention will be apparent from the following description, the accompanying drawings, and the appended claims.

DETAILED DESCRIPTION OF THE PREFERRED EMBODIMENT

Figure 1:
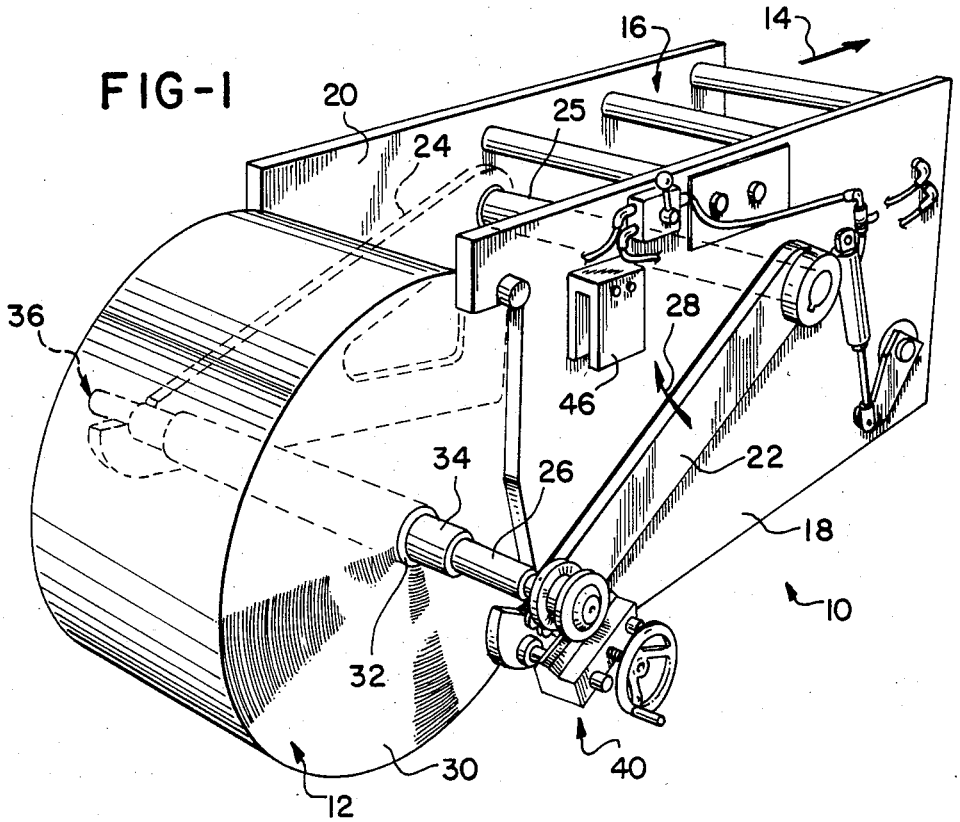
FIG. 1 is a perspective view of an unwind station for a web press, incorporating a lateral positioner and adjust mechanism in accordance with the present invention.

Referring now generally to the drawings, and in particular to FIG. 1, an unwind station 10 for a web press is shown. A roll 12 of web material, typically paper, is supported within unwind station 10 for feeding into the remaining portion of the web press, which is located with respect to unwind station 10 in the direction generally indicated by arrow 14.

In addition to supporting roll 12, unwind station 10 includes a section, indicated generally at 16, wherein one or more dancer rolls are provided for ensuring uniform tension within the web as it enters the main portion of the press. Rolls are also provided for directing the web to the dancer rolls regardless of the direction of unwinding of paper roll 12. This section of unwind station 10, as well as the remainder of the web press, may be of conventional design.

Unwind station 10 includes a pair of frame walls 18 and 20. Each wall has a support arm 22 and 24, respectively, pivotally mounted thereto by shaft 25 which interconnects arms 22 and 24. Roll 12, which is supported by a shaft 26, as will be described below, is carried at the outer ends of arms 22 and 24. Arm 24 is connected to a conventional hydraulic cylinder (not shown) which is selectively actuated to raise arms 22 and 24 in the direction indicated generally by arrow 28, thereby raising roll 12 into an operating position. After roll 12 has been consumed, arms 22 and 24 may be lowered for subsequent loading of a new roll.

Roll 12 includes the web material 30 which is wound about a central core 32, typically formed from heavy cardboard or other rigid material. Prior to loadinq of roll 12 into unwind station 10, shaft 26 is inserted through core 32. An inflatable central portion 34 is provided for shaft 26, so that by connecting a compressed air supply to portion 34 at an appropriate valve opening (not shown), portion 34 can be expanded to secure shaft 26 and roll 12 in a fixed relationship. Portion 34 is provided with indicia such as one or more grooves, lines or other markings (not shown) to enable shaft 26 to be secured within core 32 in a predetermined relative position.

To load a roll 12 into unwind station 10, the roll 12 is rolled and maneuvered into the approximate position shown in FIG. 1. Shaft 26 is inserted and secured within roll 12, whereupon arms 22 and 24 are raised to lift roll 12 into an operating position. As the web press is later operated, material is drawn from roll 12 by operation of other portions of the press, whereupon shaft 26 rotates upon appropriate bearings carried on arms 22 and 24. Since shaft 26 is not connected to the press drive train, an appropriate brake mechanism (not shown) is connected to the end of shaft 26 indicated at 36 to prevent overunning of roll 12 as the press is stopped. The brake may be of conventional design, such as, for example, an electromagnetic brake device. Connection of the brake with shaft 26 will typically be made after roll 12 has been raised into operating position.

In order to properly position printing, perforations, folds and the like laterally across the web, it is necessary to properly laterally position roll 12 within unwind station 10. Accordingly, lateral positioner and adjust mechanism 40, constructed in accordance with the present invention, is provided at one end of shaft 26.

Figure 2:
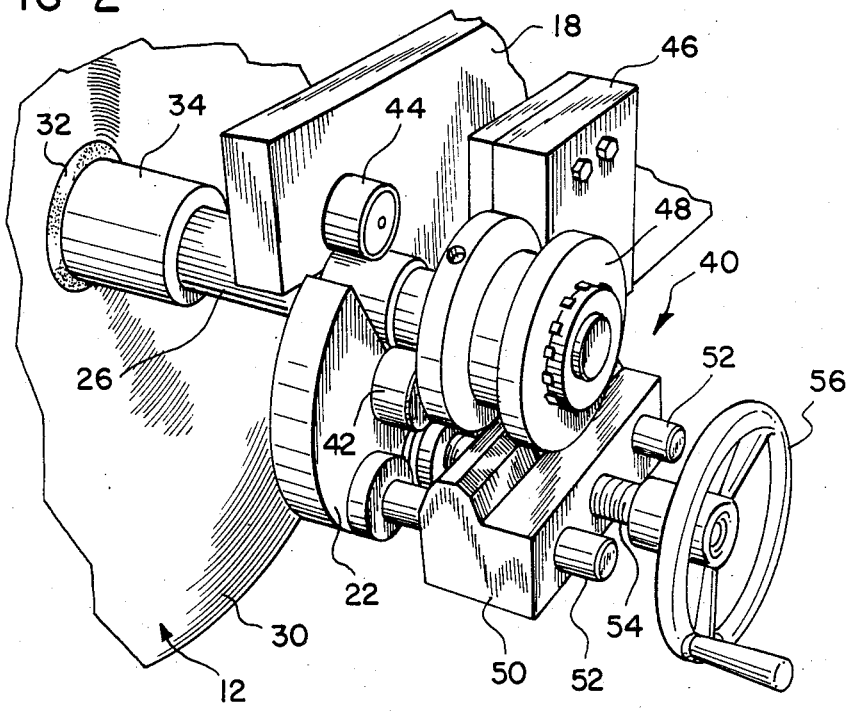
FIG. 2 is an enlarged perspective view of the positioner and adjustment mechanism, shown with the roll in an operating position.

The positioner and adjust mechanism 40 is shown in greater detail in FIG. 2, where the roll 12 is seen in its raised oprating position. Shaft 26 rests upon a pair of lower bearings 42 (only one shown) which are attached to arm 22. Shaft 26 also contacts upper bearing 44, which is secured to frame wall 18. A stop 46 is attached to the frame wall 18 (see also FIG. 1) so that upward movement of arm 22 is halted with shaft 26 properly positioned with respect to bearings 42 and 44.

Mechanism 40 includes a wheel 48 which is rotatably mounted on internal bearings (see FIG. 4) at the end of shaft 26. A block 50 is mounted to arm 22 by placement on a pair of slide shafts or rods 52. Block 50 is held in lateral position with respect to arm 22 and may be adjusted by way of a screw shaft or rod 54 which is threadingly engaged with block 50 and rotatably connected to arm 22. A wheel 56 is connected to the outer end of screw shaft 54 for controlled rotation of shaft 54 by the press operator.

Figure 3:
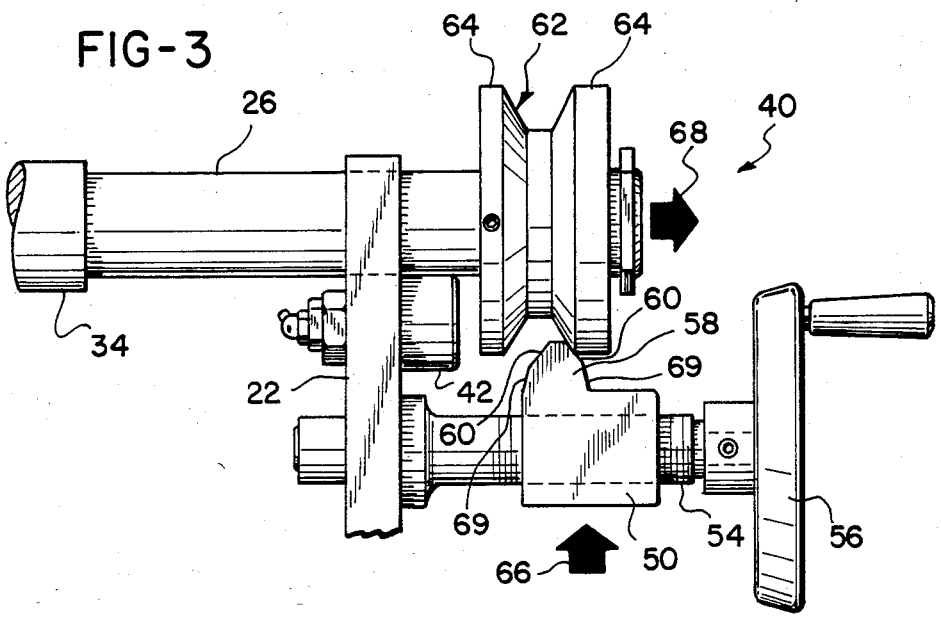
FIG. 3 is an end view of the positioner and adjust mechanism, showing the roll supporting arm as it engages the roll shaft.
Figure 4:
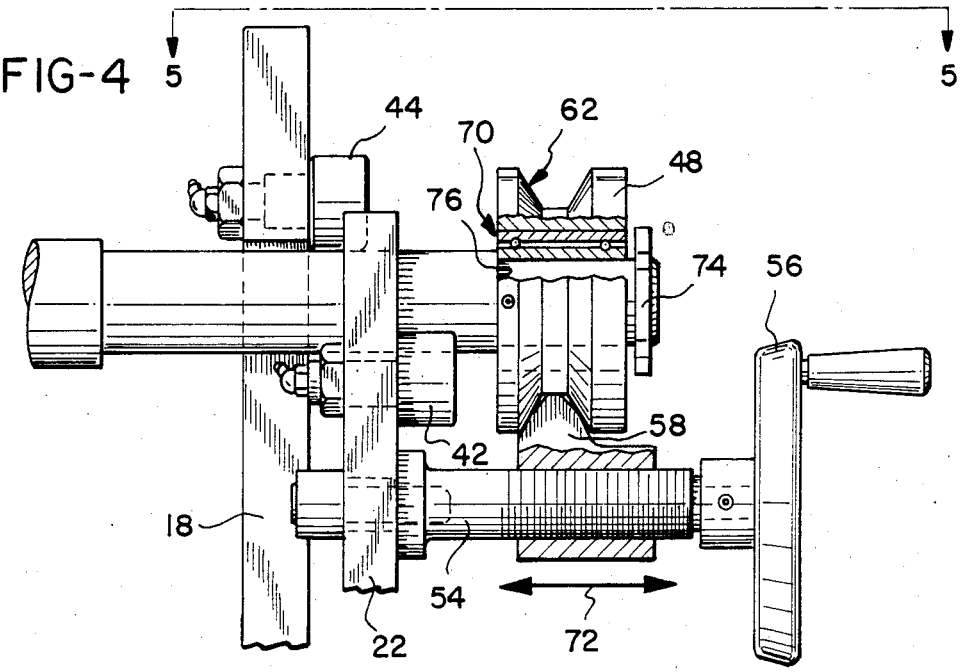
FIG. 4 is an end view of the positioner and adjust mechanism, shown with the roll support arm in its raised, operating position.

The operation of mechanism 40 can be seen by reference to FIGS. 3 and 4. Assuming that a used roll, which was properly positioned in a lateral direction, has been removed from the unwind station, shaft 26 is inserted into a new roll 12 in proper lateral relationship. Roll 12 is then positioned in approximately the correct location at the end of unwind station 10, as is shown in FIG. 1. Appropriate controls are then actuated to cause arms 22 and 24 to raise, moving towards engagement with shaft 26.

Referring to FIG. 3, it can be seen that block 50 is provided with a ridge 58 which is formed having a pair of opposing, outwardly beveled side walls 60. Further, wheel 48 is provided with a groove 62 having opposing inwardly beveled side walls 64. It should be noted that the angle formed by ridge walls 60 from the vertical is greater than that formed by groove walls 64.

As arm 22 raises toward shaft 26, indicated by arrow 66, one wall 60 of ridge 58 on block 50 will contact one wall 64 of groove 62 in wheel 48. Due to engagement of block 50 with screw shaft 54, block 50 will remain laterally stationary. (It should be noted that slide shafts 52, which also support block 50, have been omitted from FIGS. 3 and 4 for clarity.) The interaction between wall 60 and wall 64, along with the weight of the roll carried on shaft 26, will cause wheel 48 to slide downwardly into engagement with ridge 58, thereby causing lateral movement of shaft 26 in the direction indicated generally by arrow 68. Engagement of ridge 58 with groove 62 results in shaft 26 assuming the identical lateral position that was held by shaft 26 prior to the roll changing operation. Moreover, engagement of wheel 48 and block 50 brings shaft 26 into full contact with bearings 42.

Ridge 58 may be provided with lower beveled walls 69, which are formed having a bevel angle different from walls 60 and either identical or approximately identical to the bevel angle of walls 64 of groove 62. Lower walls 69 provide a more positive engagement of ridge 58 with groove 62 after proper lateral position of shaft 26 has been achieved.

Upward movement of support arms 22 and 24 is continued until roll 12 has been fully lifted into its operating position, as shown in FIG. 4. At such time, shaft 26 will be brought into contact with bearing 44, so that rotation of roll 12, as a result of press operation, will cause shaft 26 to rotate on bearings 42 and 44. It should be recognized that due to engagement of groove 62 with ridge 58, wheel 48 will be held stationary as shaft 26 rotates. However, bearings 70 are provided between shaft 26 and wheel 48, so that shaft 26 will rotate freely within wheel 48.

In the event it becomes necessary to adjust the lateral position of roll 12, regardless of whether the press is operating or stopped, the operator rotates wheel 56 in either direction which in turn rotates screw shaft 54. Due to the threaded engagement of shaft 54 with block 50, rotation of wheel 56 causes lateral movement of block 50 as indicated by arrow 72. Because of the engagement of ridge 58 with groove 62, lateral movement of block 50 will in turn cause lateral movement of wheel 48. Since wheel 48 is secured to shaft 26 by fitting 74 and a narrowed portion 76 of shaft 26, rotation of wheel 56 will therefore result in lateral movement of the shaft for adjustment of the roll.

Figure 5:
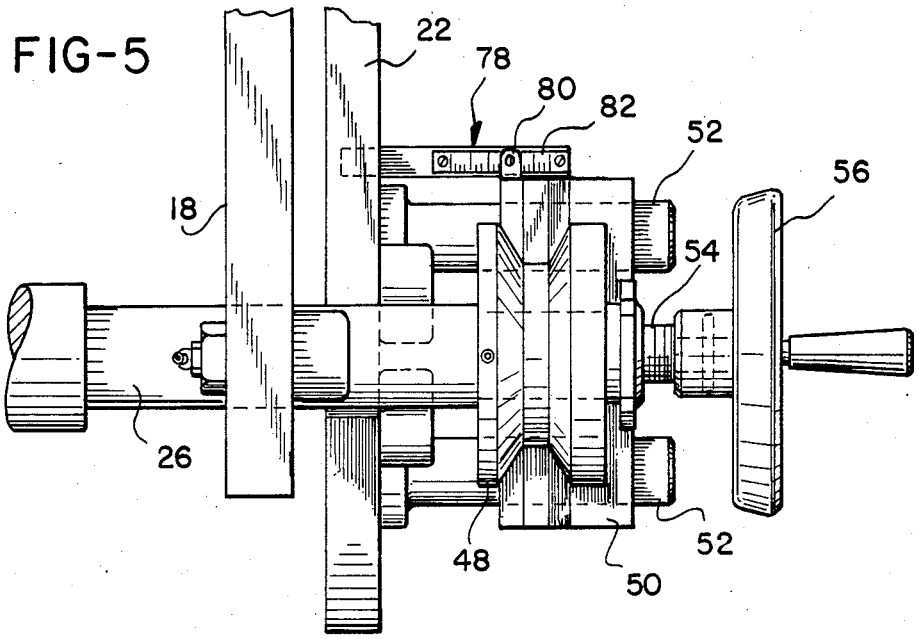
FIG. 5 is a top plan view of the positioner and adjust mechanism, taken generally along line 5—5 of FIG. 4.

Referring now to FIG. 5, an additional view of mechanism 40 is presented. A scale 78 or other indicia is provided for the mechanism 40 so that the operator can carry out a specific adjustment or setting. While scale 78 is shown as a rule 80 fixed to arm 22 and a cooperating sight piece 82 fixed to block 50, it will be recognized that many other types of scales or indicia could be used with mechanism 40.

It should also be recognized that in the positioner and adjust mechanism disclosed herein, wheel 48 defines a first contact member while block 50 defines a second contact member. In the preferred embodiment, as described above, the groove 62 is defined in the first member, while ridge 58 is formed on the second member. However, these elements could be reversed, i.e., a ridge could be formed about the periphery of wheel 48 while a groove is defined in block 50. As with the preferred embodiment, the angle from vertical formed by the bevel on the ridge will be greater than that formed by the bevel in the groove.

Moreover, the first contact member need not be a wheel, but rather need only be a block or some other member into which a groove or on which a ridge can be formed. A wheel 48 is preferred, however, since in such a case the operator need not be concerned with the rotational position of either shaft 26 or the first contact member carried thereon.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A lateral positioner and adjust mechanism for use within an unwind station of a web press, the unwind station including a frame, a shaft for supporting a roll of web material, first and second arms pivotally mounted to said frame and cooperating for supporting said shaft for rotation thereon, means for selectively pivotally raising and lowering said arms and for retaining said arms in a raised position, said positioner and adjust mechanism comprising:

said shaft extending at a first end beyond said first arm;

means for defining a first contact surface mounted to said first end of said shaft;

means for defining a second contact surface attached to said first arm positioned beneath said shaft when said shaft is supported by said arms;

one of said first and second contact surface means defining a groove having opposing side groove walls, each of said groove walls defining an outward bevel;

the other of said first and second contact surface means defining thereon a ridge extending upwardly and perpendicular to said shaft, said ridge having opposing side ridge walls, each of said ridge walls having an inward bevel, said ridge being fittable within said groove; and means for selectively moving said second contact surface means toward and away from said first arm in a direction parallel to said shaft.

2. A lateral positioner and adjust mechanism as defined in claim 1, wherein said first contact surface means includes a wheel rotatably mounted to said shaft.

3. A lateral positioner and adjust mechanism as defined in claim 1, wherein said second contact surface means includes a rigid block.

4. A lateral positioner and adjust mechanism as defined in claim 1, wherein said groove is defined in said first contact surface means and said ridge is defined in said second contact surface means.

5. A lateral positioner and adjust mechanism as defined in claim 1, wherein said ridge is defined in said first contact surface means and said groove is defined in said second contact surface means.

6. A lateral positioner and adjust mechanism for use within an unwind station of a web press, the unwind station including a frame, a shaft for supporting a roll of web material, first and second arms pivotally mounted to said frame and cooperating for supporting said shaft for rotation thereon, means for selectively pivotally raising and lowering said arms and for retaining said arms in a raised position, said positioner and adjust mechanism comprising:

said shaft extending at a first end beyond said first arm;

a wheel mounted to said first end of said shaft, said wheel defining a groove having opposing side groove walls, each of said groove walls defining an outward bevel;

a block attached to said first arm and positioned beneath said shaft when said shaft is supported by said arms, said block defining thereon a ridge extending upwardly and perpendicular to said shaft, said ridge having opposing side ridge walls, each of said ridge walls having an inward bevel, said ridge being fittable within said groove; and means for selectively moving said block toward and away from said first arm in a direction parallel to said shaft.

7. A lateral positioner and adjust mechanism as defined in claim 6, wherein said wheel is mounted to said shaft for rotation on said shaft.

8. A lateral positioner and adjust mechanism as defined in claim 6, wherein said ridge walls define an angle from vertical greater than an angle from vertical defined by said groove walls.

9. A lateral positioner and adjust mechanism as defined in claim 6, wherein said block is attached to said arm by at least one slide rod, said slide rod being secured to said arm and said block defining a smooth bore for placement of said slide rod therethrough.

10. A lateral positioner and adjust mechanism as defined in claim 9, wherein said selective moving means includes a threaded rod and said block defines a threaded bore, said threaded rod engaging said threaded bore and being rotatably secured to said arm.

* * * * *